US005515911A

United States Patent [19]

Boula et al.

[11] Patent Number: 5,515,911

[45] Date of Patent: May 14, 1996

[54] HEAT EXCHANGER INCLUDING A BUNDLE OF TUBES WHICH ARE BENT INTO A U AND ANTI-VIBRATION BARS BETWEEN THE BENT PARTS OF THE TUBES

[75] Inventors: Gérard Boula, Corpeau; Christian Valadon, Paris, both of France

[73] Assignee: Framatome, Courbevoie, France

[21] Appl. No.: 272,751

[22] Filed: Jul. 11, 1994

[30] Foreign Application Priority Data

Jul. 9, 1993 [FR] France ..... 9308513

[51] Int. Cl.[6] ..... E28F 9/00

[52] U.S. Cl. ..... 165/69; 165/162; 122/510

[58] Field of Search ..... 165/69, 162; 122/510

[56] References Cited

U.S. PATENT DOCUMENTS

| | | | |
|---|---|---|---|
| 2,853,278 | 9/1958 | Hesler | 206/593 |
| 3,212,567 | 10/1965 | Romanos | 165/69 |
| 4,895,204 | 1/1990 | Johnson et al. | 165/162 |
| 5,005,637 | 4/1991 | Gentry | 165/69 |
| 5,269,371 | 12/1993 | Boula et al. | 165/69 |

FOREIGN PATENT DOCUMENTS

| | | | |
|---|---|---|---|
| 011959 | 6/1980 | European Pat. Off. . | |
| 544579 | 6/1993 | European Pat. Off. . | |
| 54359 | 4/1979 | Japan | 165/162 |
| 242796 | 10/1987 | Japan | 165/162 |

*Primary Examiner*—Leonard R. Leo
*Attorney, Agent, or Firm*—Pollock, Vande Sande & Priddy

[57] ABSTRACT

An element (18) of elongate form is fastened onto the tube support plate (8*a*) of the steam generator nearest the bent parts (10*c*, 10″*c*, 10‴*c*) of the tubes (10) of the bundle, in a central free zone of the bundle, in line with the small bends (10″*c*) of the tubes of the bundle. Anti-vibration bars (15) of a set of bars which are intended to be placed between any two adjacent rows (20) of the bundle of tubes are fastened by their internal end onto a dovetail piece (16) which is attached to the elongate element (18). All the anti-vibration bars (15) intended to come into a space contained between two successive rows (20) of the bundle of the heat exchanger are thus fitted in a single operation. The invention applies in particular to steam generators of pressurized water nuclear reactors.

10 Claims, 5 Drawing Sheets

HEAT EXCHANGER INCLUDING A BUNDLE OF TUBES WHICH ARE BENT INTO A U AND ANTI-VIBRATION BARS BETWEEN THE BENT PARTS OF THE TUBES

FIELD OF THE INVENTION

The invention relates to a heat exchanger including a bundle of tubes which are bent into a U and anti-vibration bars between the bent parts of the tubes. The invention applies in particular to a steam generator of a pressurized water nuclear reactor.

BACKGROUND OF THE INVENTION

Steam generators of pressurized water nuclear reactors include tubes which are bent into a U having two straight branches crimped at their ends into a tube plate. The straight branches of the tube are held by tube support plates spaced along the length of the straight branches and through which the straight branches pass. The tubes of the bundle are thus held in a regular arrangement in which the straight branches are all parallel to each other and the tubes arranged in plane rows which are parallel to each other, in each of which the tubes whose bent parts have radii of curvature decreasing from the outside towards the inside of the row are juxtaposed, the ends of the tubes of one row being engaged in a rectilinear line of openings passing through the tube plate.

The tubes in one row and the adjacent rows are separated by narrow free spaces allowing the feedwater of the steam generator to pass inside the bundle, in contact with the outside exchange surface of the tubes of the bundle.

Furthermore, the tubes situated at the central part of each of the rows and which include the bends of smallest radius of curvature are aligned, so as to delimit between them a free space whose lower part, above the tube plate of the steam generator, constitutes the tube lane of the steam generator.

The curved parts of the tubes of each of the rows of the bundle have different radii of curvature and are juxtaposed so as to constitute a structure of substantially hemispherical shape, termed the tube bend region, at the upper part of the bundle of the steam generator.

During operation of the steam generator, water under pressure and at high temperature flows through the tubes of the bundle and feedwater is brought into contact with the external exchange surface of the tubes along which it moves in the vertical direction while heating up and then vaporizing, to emerge in the form of steam at the upper part of the steam generator.

The flow of the fluids in contact with the tubes may cause vibrations which can lead to damage to the tubes if they are not held efficiently.

The straight part of the tubes which is engaged in the tube support plates is held efficiently by the supports made in the form of rigid plates. The curved parts of the tubes of the bundle constituting the tube bend region should also be held, and anti-vibration bars are generally used for this which are interposed between the adjacent rows of tubes of the bundle and arranged in substantially radial directions of the tube bend region. These anti-vibration bars, as described for example in U.S. Pat. No. 3,007,679, may be folded or assembled so as to have the shape of a V whose two branches are directed in use along the radial directions of which the tube bend region between the rows of tubes of each of the pairs of adjacent rows.

The ends of the branches of the anti-vibration bars opposite their common ends are generally projecting with respect to the tubes constituting the external layer of the tube bend region and connected together by curved bars resting on the external surface of the tube bend region on which the external end parts of the anti-vibration bars are welded.

Other ways of fastening the external ends of the anti-vibration bars have also been proposed more recently; these might employ removable fastening elements, such as screwed elements.

It has also proved necessary to provide means for fastening and connection of the internal part of the anti-vibration bars, in the vicinity of their folded or articulated part, onto a structural element of the steam generator.

Applicants' US-A-5,269,371, means were provided for fastening the anti-vibration bars to prevent their ejection out of the bundle in the generator in use, which means comprise an elongate structure fixed onto the tube support plate of the steam generator nearest the curved parts of the tubes constituting the tube bend region. The elongate structure, generally constructed in the form of a rail, is fixed onto the upper face of the tube support plate, in a direction perpendicular to the rows of tubes, inside the central free space constituting the tube lane of the steam generator. The elongate fastening structure includes, at each of the spaces between two couples of adjacent tube rows, at least one notch in which the internal part of the anti-vibration bar can be engaged.

Between two adjacent rows of the bundle, three V-shaped anti-vibration bars are generally arranged, including in total six branches which should be placed in radial directions of the tube bend region with some degree of angular distribution.

It is therefore necessary to place, at spaces between two adjacent rows of tubes of the bundle and possibly to fasten into notches of the elongate element, three double anti-vibration bars with angular spacings between their different branches.

The design and the structure of the elongate fastening element are relatively complex because steam generators include a large number of rows of tubes, for example of the order of 130.

It is therefore necessary to provide a very large number of notches machined in the elongate fastening element.

Applicants' FR-A-2,603,364 a method for fitting tubes of a steam generator in successive rows was provided, in which the anti-vibration bars are set bearing on the curved parts of the tubes of the last row which has been fitted, with controlled bearing forces substantially corresponding to the bearing force of the rows intended to rest on the row during mounting. It is checked that the anti-vibration bars subjected to the bearing forces actually are in contact with all the tubes of the row, and the defective tubes on which the anti-vibration bars cannot bear are possibly eliminated. Defect-free mounting of the steam generator, and in particular of the anti-vibration bars which bear perfectly on the curved parts of the tubes constituting the successive rows of the bundle is thus achieved.

It is clear that the mounting of the bundle of the steam generator is facilitated and improved when an internal element for fastening the anti-vibration bars is used, such as an elongate element including notches, solidly attached to the upper tube support plate of the steam generator. However, because each of the anti-vibration bars must be fixed onto the elongate anti-fly-off holding element separately, the operations of fitting the anti-vibration bars remain relatively lengthy, because of the large number of rows and anti-vibration bars in the bundle of the steam generator.

SUMMARY OF THE INVENTION

The object of the invention is therefore to provide a heat exchanger comprising a bundle of tubes which are bent into a U so as to have two straight branches, and a curved part between the two straight branches, tube support plates spaced along the length of the straight branches of the tubes and passed through by the straight branches, holding the tubes of the bundle in a regular arrangement in which the straight branches are all parallel to each other and the tubes arranged according to plane rows which are parallel to each other, a plurality of anti-vibration bars interposed between the rows of each of the pairs of adjacent rows of the tubes in their curved part, and means for fastening and connecting the anti-vibration bars, including at least one elongate element fastened onto the tube support plate nearest the curved parts of the tubes, in a direction perpendicular to the rows of the tubes, within a free space between the straight branches of the tubes situated at the central part of the rows, this heat exchanger including means, of simple form, for fastening the support bars to allow simplified and more rapid mounting of the bundle.

For this purpose:

the anti-vibration bars are simple rectilinear bars, and the means for fastening the anti-vibration bars include, between the two rows of each of the pairs of adjacent rows, a dovetail connection piece including means for connecting the anti-vibration bars of the plurality of bars, in radial arrangements, and means for attaching the connection piece onto the elongate element.

BRIEF DESCRIPTION OF THE DRAWINGS

In order better to explain the invention, one embodiment of a heat exchanger according to the invention, constituting a steam generator of a pressurized water nuclear reactor, will now be described by way of example, with reference to the appended drawings.

DETAILED DESCRIPTION

Figure 1:
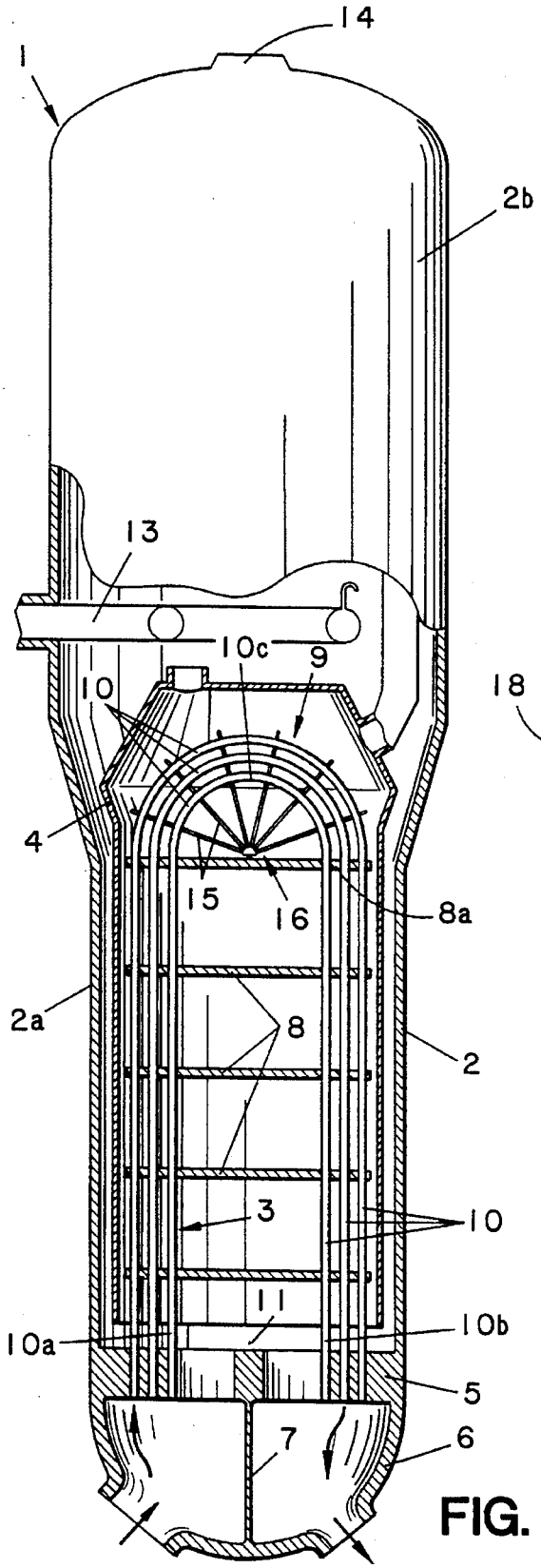
FIG. 1 is an elevation with partial section of a steam generator of a pressurized water nuclear reactor.

FIG. 1, shows a steam generator 1 of a pressurized water nuclear reactor.

The steam generator includes an external wrapper 2 which has a lower part 2*a* with the shape of a cylindrical shell in which the bundle of tubes 3 of the steam generator is arranged, inside a bundle wrapper 4. The diameter of the upper part 2*b* of the wrapper 2 of is greater than that of the lower part 2*a* and encloses means for separating and drying the steam produced in contact with the bundle 3.

The lower end part of the shell 2*a* of the wrapper 2 is solidly attached to a thick tube plate 5 which is traversed by openings in which the tubes of the bundle 3 are inserted and fixed by expansion-rolling and welding. A hemispherical casing 6 delimiting the water box of the steam generator, in two parts separated by a partition 7, is also fastened onto the tube plate 5, opposite the shell 2*a* of the wrapper 2.

Each of the two parts of the water box is connected by a pipe to the primary system of the nuclear reactor through which the pressurized water for cooling the core of the reactor flows.

The bundle 3 consists of tubes 10 which are bent into a U shape. Each of the tubes 10 includes rectilinear branches 10*a*, 10*b* and a substantially semi-circular curved part 10*c* connecting the straight branches 10*a* and 10*b*.

The ends of the branches 10*a* and 10*b* are engaged and expansion-rolled in the openings passing through the tube plate 5, on either side of the partition 7.

The straight branches 10*a*, 10*b* of the tubes 10 of the bundle are also engaged in openings passing through the tube support plates 8 spaced along the height of the bundle. The network of openings of each of the tube support plates reproduces the network of openings of the tube plate 5, so that the branches 10*a* and 10*b* are held in parallel arrangements.

Figure 2:
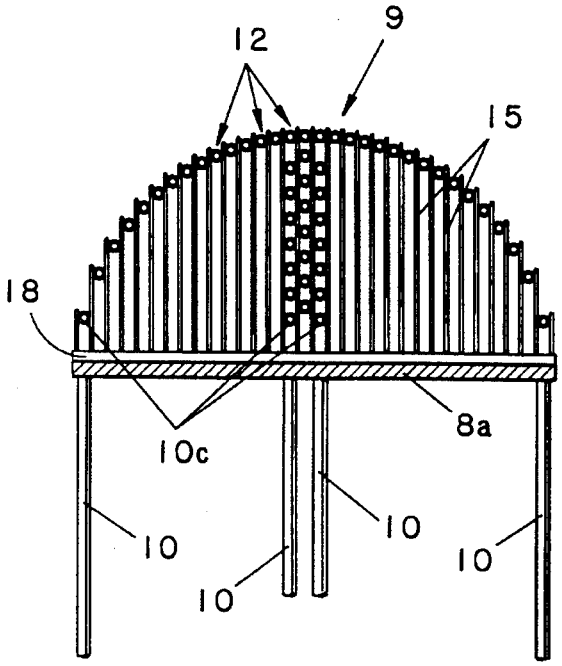
FIG. 2 is a schematic section of the upper part or tube bend region of the bundle of the steam generator represented in FIG. 1.

Furthermore, the network of openings of the tube plate 5 and of the tube support plates 8 includes rectilinear lines in which are engaged the straight branches of tubes 10 whose bent part 10*c* has a radius of curvature decreasing from the outside towards the inside of the bundle. The tubes of the bundle thus constitute successive rows 12 which can be seen in particular in FIG. 2. In each of the rows, the radii of curvature of the bent parts 10*c* or bends of the tubes decrease from the outside towards the inside, i.e., from top to bottom; furthermore, the radius of curvature of the outermost tube of the row having the maximum radius of curvature decreases from the internal central part towards the outside of the bundle.

For this reason, the tube bend region 9 constituted by the juxtaposed bends 10*c* of the tubes 10 has a substantially hemispherical shape. The networks of holes for engaging of the tubes of the tube plate 5 and the tube support plates 8 are interrupted at the central part of the plates in a diametral direction, so as to delimit a free space or tube lane 11 at the central part of the bundle between the branches of the tubes which have the smallest radii of curvature under the small bends which are aligned in the diametrical direction of the tube lane 11.

The steam generator 1 includes a ring 13 arranged above the upper part of the bundle wrapper 4 in which the tube bend region 9 is placed.

When the steam generator is in operation, pressurized water for cooling the reactor penetrates into one of the compartments of the water box so as to be distributed inside the branches of the tubes of the bundle emerging in this inlet compartment. The pressurized water flows inside the tubes to emerge in the second compartment of the water box through the second branches 10*b* of the tubes 10. The water collected at the outlet of the tubes of the bundle is returned to the vessel of the nuclear reactor via a duct of the primary system.

The feedwater introduced into the wrapper of the steam generator 2 through the feed ring 3 flows from top to bottom in an annular space between the bundle wrapper 4 and the external wrapper 2 of the steam generator, then penetrates inside the bundle wrapper 4 to come into contact with tubes 10 above the upper face of the tube plate 5. The feedwater flows from bottom to top within the bundle, in contact with the tubes, and heats up then vaporizes by heat exchange with the pressurized water flowing inside the tubes. The steam formed in contact with the tubes of the bundle is sent into the upper part 2*b* of the steam generator to be dried, then removed through the upper end 14 of the steam generator.

The tubes of a bundle within each of the plane rows of tubes 12 are placed with some degree of spacing, and the rows are also arranged with respect to each other with some degree of spacing. The feedwater of the steam generator can thus flow in contact with the entire external surface area of the tubes.

The water flowing at high speed in contact with the surface of the tubes generates vibrations of these tubes 10 whose straight branches are perfectly held by the tube support plates 8.

In order to ensure holding of the bends 10*c* of the tubes, within the tube bend region 9, support bars 15 are arranged in each of the free spaces between two adjacent rows 12, so that the branches of the anti-vibration bars are placed in radial directions and two successive branches along the contour of the bends 10*c* form a substantially constant angle.

As will be explained in more detail below, in the case of the invention, the anti-vibration bars 15 are simple rectilinear bars which therefore each include a single branch.

Furthermore, the anti-vibration branches 15 are fastened at their end part situated inside the tube bend region 9 onto a connection piece 16, fastened onto an elongate element 18 solidly attached to the tube support plate 8*a* situated in the position nearest the tube bend region 9, i.e., the uppermost tube support plate of the bundle.

The elongate element 18, which will be described in more detail below, is fastened onto the tube support plate 8*a*, in a diametral direction, in the upper part of the free space constituting the tube lane 11, below the aligned small bends of the bundle of the steam generator.

Figure 3:
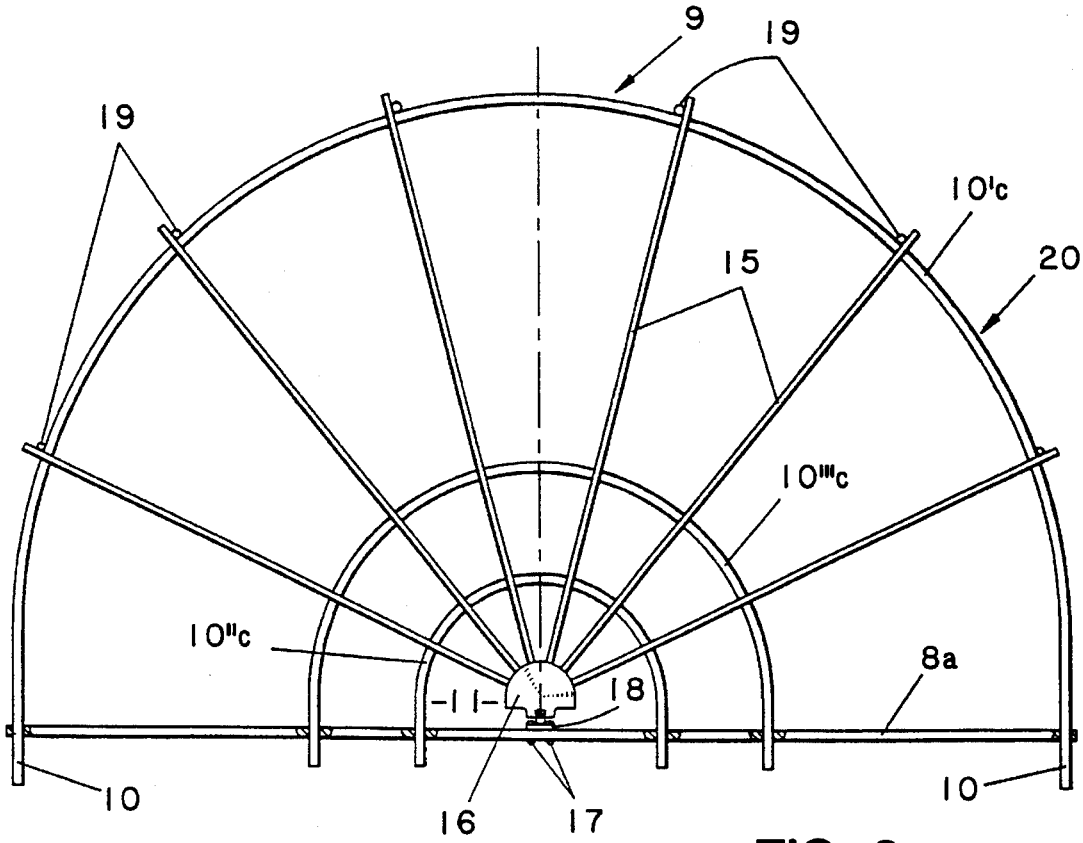
FIG. 3 is an elevation of the anti-vibration bars arranged in a space between two successive rows of tubes of the bundle of the steam generator represented in FIGS. 1 and 2.

In FIG. 3, three bends 10'*c*, 10"*c* and 10'"*c* of tubes 10 of the bundle of the steam generator, which are situated in the same tube row, have been represented.

The bend 10'*c* is the large bend of the row of tubes situated at the outside of the tube bend region 9, the bend 10"*c* constitutes the small bend situated at the internal part of the tube bend region 9, and the bend 10'"*c* is an intermediate bend whose radius of curvature lies between the radius of curvature of the large bend 10'*c* and the radius of curvature of the small bend 10"*c*.

The row of tubes including the bends 10'*c*, 10"*c* and 10'"*c* will be denoted by the reference 20.

Six anti-vibration bars 15 are arranged in a free space between the row of tubes 20 and an adjacent and parallel row of tubes, in radial directions of the tube bend region, so that any two bars 15 which follow each other along the direction of the bends of the tube bend region 9 form between them a substantially constant angle, for example of the order of 20°.

An elongate element 18, which has the form of a rail, is fastened onto the upper face of the tube support plate 8*a* of the steam generator nearest the bends of the bundle, by fastening means 17. The elongate element 18 is fastened onto the tube support plate 8*a*, in a diametral direction of the circular section of the bundle, in the upper part of the free space 11 below the small bends such as 10"*c* of the bundle which are aligned in the diametral direction of the space 11.

The anti-vibration bars 15 are simple rectilinear bars which have a cross section which may be of rectangular shape. The anti-vibration bars 15 are all fastened at their internal ends, onto a semicircular or dovetail connection piece 16 which is attached onto the rail 18, for example by means of an opening engaged on a tenon machined in the rail 18.

The opposite end of the anti-vibration bars 15 can be fastened by welding, in a conventional manner, onto a curved bar 19 resting on the upper part of the tube bend region 9, in contact with the large bends 10'*c*, or by mechanical fastening.

Figure 4:
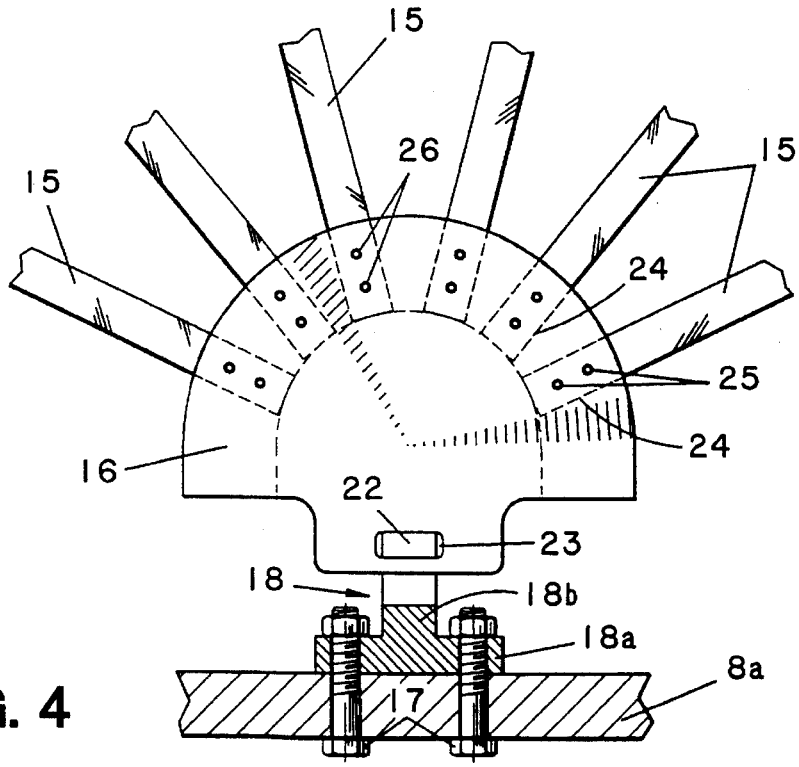
FIG. 4 is a partial view on a larger scale of the means for connecting the anti-vibration bars represented in FIG. 3.
Figure 5:
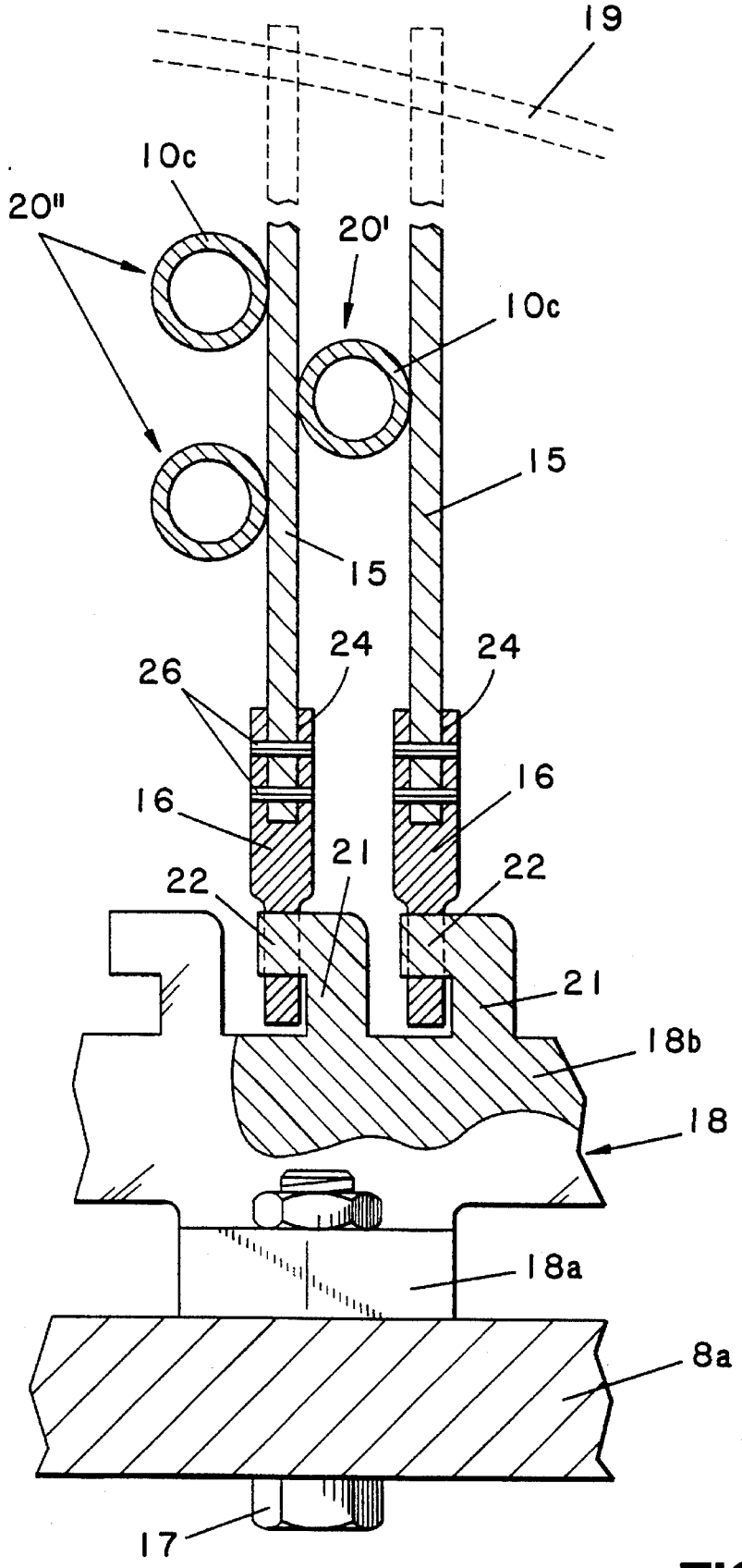
FIG. 5 is a partial elevation and section in a vertical plane, perpendicular to the lines of tubes, of the means for connecting and fastening the anti-vibration bars of the steam generator according to the invention.

In FIGS. 4 and 5, the rail 18 has been represented fastened onto the upper face of the tube support plate 8*a*, in a diametral direction, in a central part of the tube support plate 8*a* between the holes for passage of the tubes 10 of the bundle.

The rail 18 has a heel 18*a* which is fastened by screw-and-nut fastening assemblies 17 onto the tube support plate 8*a*. The fastening screw is inserted into openings passing through the tube support plate 8*a* and the heel 18*a* which are made to coincide. In another embodiment, (not shown), the rail 18 may also be welded directly onto the upper tube support plate 8*a*, if the materials constituting these two pieces so allow.

The rail 18 includes an upper attachment piece 18*b* in the form of a comb whose successive teeth 21 have an attachment lug 22 extending parallel to the base 18*a* and to the tube support plate 8*a*. The separation of the teeth 21 and of the attachment lugs 22 corresponds to the distance between two successive free spaces between adjacent rows of tubes, such as the rows 20' and 20" represented in FIG. 5.

In each of the free spaces between two successive rows of tubes is arranged a dovetail connection piece 16 onto which the internal ends of the anti-vibration bars 15 are fastened.

The dovetail connection piece 16 includes a heel traversed by an opening 23 which may be engaged on an attachment lug 22 of a tooth 21 of the comb-shaped attachment part 18*b* of the rail 18.

The connection piece 16 also includes a part bounded by a substantially semicircular contour, containing recesses 24, directed radially with respect to the external contour of the connection piece 16, and having shapes and cross-sectional dimensions of which correspond to those of the rectangular cross-section of the anti-vibration bars 15.

The recesses 24 are open on the external face of the connection piece 16 and are arranged in succession, so that their axes directed radially with respect to connection piece 16 form a substantially uniform angles.

In the embodiment represented in FIGS. 4 and 5, the connection pieces 16 have six recesses 24 intended to receive the internal ends of six anti-vibration bars 15, but it is clear that a different number of recesses, for example five, may be provided in order to accommodate five anti-vibration bars in each of the spaces between two successive rows of tubes.

On the other hand, in the case of V-shaped anti-vibration bars including two branches, it is possible to use an odd number of anti-vibration bar branches, so as best to ensure the symmetry of the arrangement of the anti-vibration bars in the tube end region of the steam generator.

Two holes 25 are pierced through the two walls of the connection piece 16, at each of the recesses 24 of an anti-vibration bar 15. The anti-vibration bar 15 is pierced with holes which are aligned with the holes 25 of the connection piece 16, during the engagement of the end of the anti-vibration bar 15 in the housing 24.

The anti-vibration bars 15 are fastened by pins 26 which are engaged in the aligned openings of the piece 16 and of the anti-vibration bars.

It is thus possible to mount the anti-vibration bars 15 on the connection piece 16 easily, before attaching the latter onto the lug 22 of the rail 18, during mounting of the bundle of the steam generator, as will be explained below.

During mounting of an assembly including antivibration bars 15 and a connection piece 16, it is also easy to replace a damaged anti-vibration bar by driving out the pins 26 to extract the damaged anti-vibration bar from its housing 24.

The fitting of the necessary assembly of anti-vibration bars between two rows of tubes can be carried out rapidly and very easily by simple attachment of a connection piece onto the corresponding attachment means of the rail, which are fixed onto the tube support plate.

Figure 6:
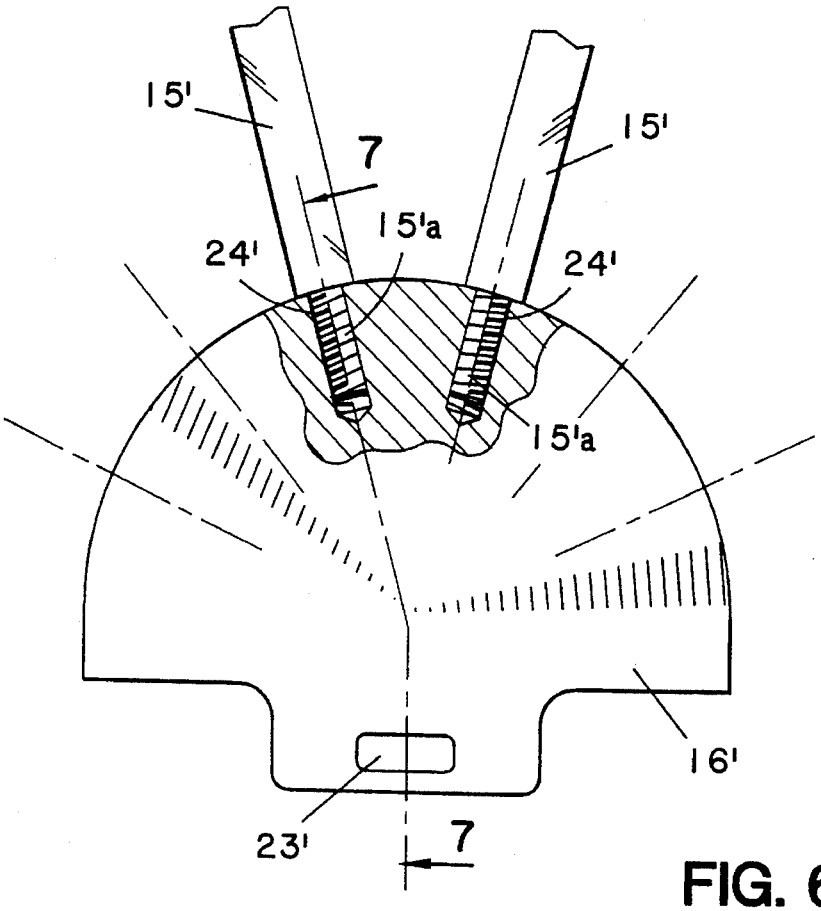
FIG. 6 is a view, substantially similar to the view in FIG. 4, of a variant embodiment of the means for fastening the anti-vibration bars.
Figure 7:
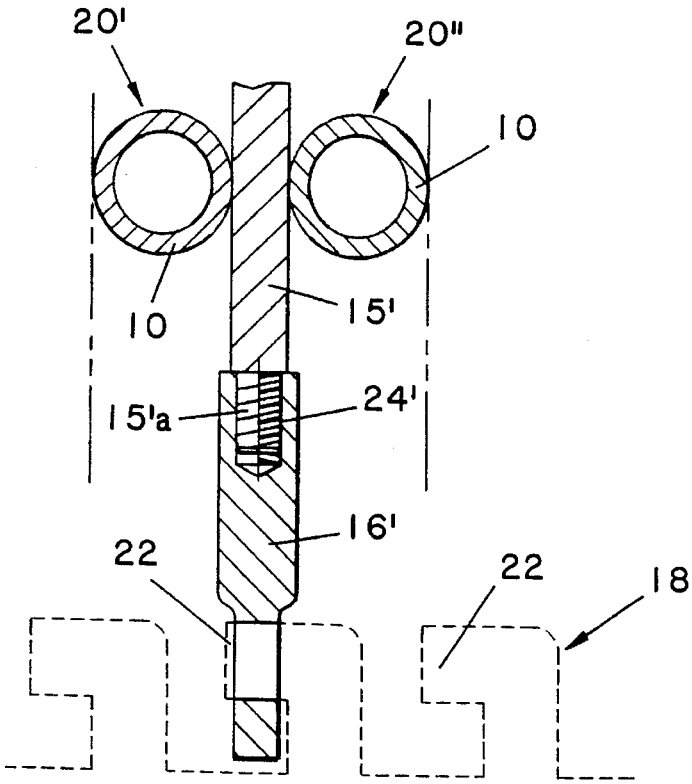
FIG. 7 is a section along line 7—7 in FIG. 6.

In FIGS. 6 and 7, a variant embodiment of the assembly of anti-vibration bars intended to be inserted between two adjacent rows of tubes, and of the means for connecting these anti-vibration bars, have been represented.

The anti-vibration bars 15' include an internal end **15'*a* which is threaded, and the dovetail connection piece 16' includes a set of radial recesses 24' which are tapped so as to receive the ends 15'*a* of the anti-vibration bars 15' which are screwed into the connection piece 16'**.

The connection piece 16' includes a heel which is traversed by an opening 23' allowing attachment of the piece 16' in a desired position between two rows of tubes 20', 20" on a lug 22 of the rail 18, as previously described.

It is clear that the device according to the embodiment in FIGS. 6 and 7 has advantages substantially equivalent to those of the device represented in FIGS. 4 and 5.

Figure 8:
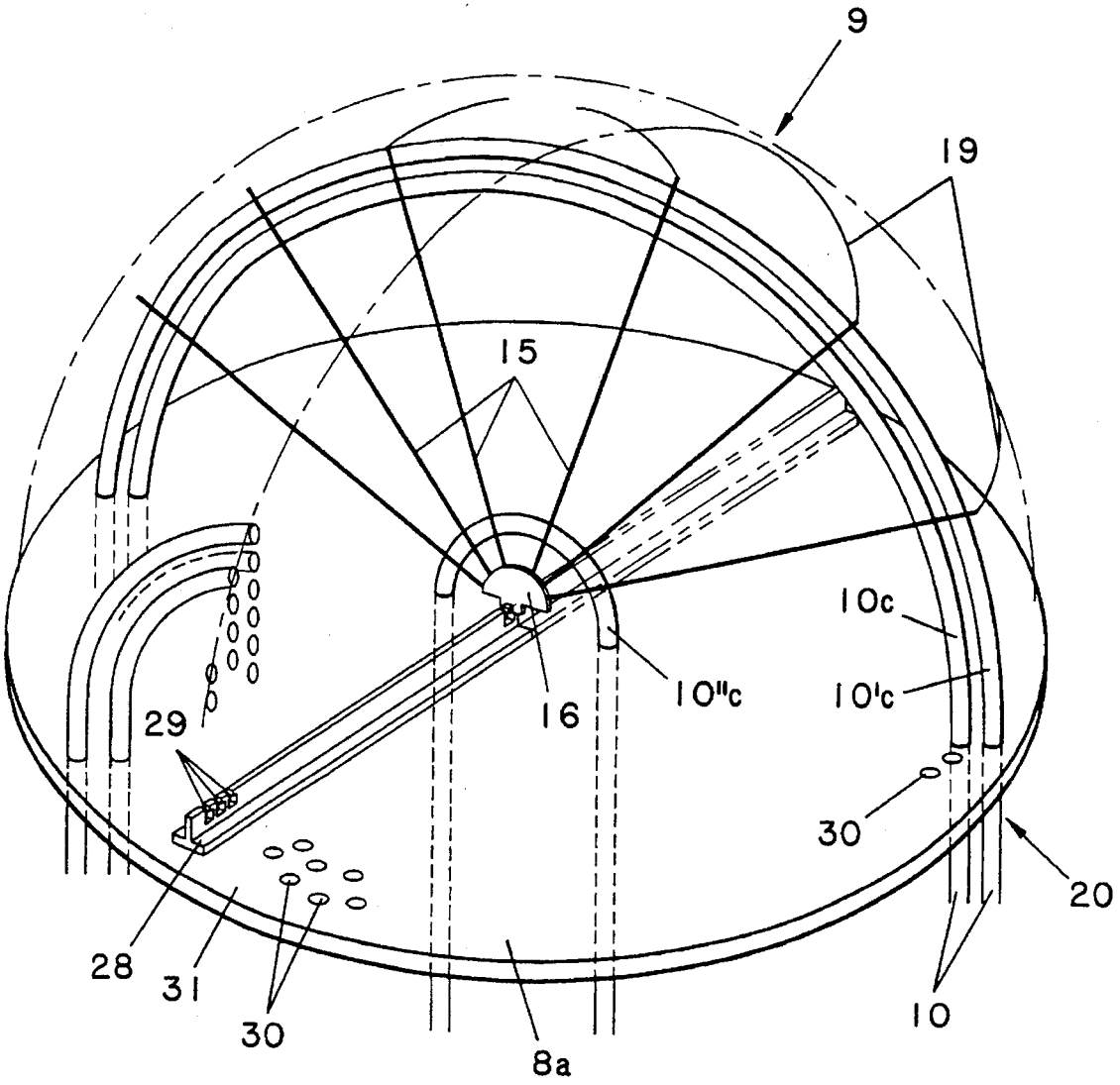
FIG. 8 is a partial view in perspective of the tube bend region of the steam generator showing all the means for fastening and connecting the anti-vibration bars.

In FIG. 8, the upper part 9 or tube bend region of the bundle of a steam generator has been represented. The tube bend region 9 consists of the bends **10*c* of the tubes 10 of the steam generator which are arranged and held in plane rows 20 by the supports of the steam generator such as the upper support 8*a* which includes through holes 30** in which the end parts of the straight branches of the tubes are engaged.

The network of holes 30 of the upper support **8*a* of the steam generator is interrupted in the central part of the support, over a diametral zone 31 which constitutes a free zone within the bundle, below the bent parts such as the bend 10"*c* represented in FIG. 8**.

An elongate element 28 consisting of a profiled rail with a T-shaped cross-section is fixed onto the upper surface of the support **8*a* along a diameter of the tube support plate, in the free zone 31 below the small bends 10"*c***.

The central web of the profiled rail 28, which web is placed perpendicular to the tube support plate **8*a*, is cut out to constitute successive notches 29 spaced along the length of the profiled section by a distance substantially equal to the distance separating two adjacent rows 20** of tubes of the bundle of the steam generator.

The planar base of profiled rail 28 is welded or screwed onto the upper face of the tube support plate **8*a***.

The notches 29, regularly spaced along the length of the rail 28, pass through the web of the profiled rail 28 over its entire thickness and delimit teeth and attachment lugs which may be identical to the teeth 21 and to the lugs 22 represented in FIG. 5.

In each of the spaces between two adjacent rows of tubes 20, during mounting of the tubes of the bundle, a set of rectilinear anti-vibration bars 15, fastened at their lower end part to a connection piece 16 including an attachment opening which is engaged on a lug between two successive notches 29 of the rail 28, is fitted in a single operation.

The anti-vibration bars 15 include outer ends opposite the ends fastened onto the connection piece 16, which may be fastened by welding onto curved bars 19 called connection U-rods, or by mechanical fastening.

The fitting of the tubes of the bundle and of the anti-vibration bars, during mounting of the bundle, can be carried according to the method described in FR-A-2,603,364. According to this method, the structure for accommodating the tubes of the bundle, namely, the tube support plates and the tube plate of the steam generator, are fastened in their final relative position and the rows of tubes 20 are fitted in succession into the accommodating structure.

The upper tube support plate carries the rail 28 for fastening the internal ends of the anti-vibration bars 15.

Referring to FIG. 8, it will be assumed that row 20 is the last row whose tubes have been fitted in the tube support and the tube plate.

After fitting the tubes of the row 20, attachment is carried out of the piece 16 for connecting a set of anti-vibration bars such as the six anti-vibration bars 15 represented in FIG. 8, onto the corresponding attachment lug of the rail 28, so that the bars 15 bear on the set of bends **10*c*, 10'*c*, 10"*c* of the tubes of the row 20. This attachment is carried out in a single operation, by inserting the connection piece 16 into the corresponding notch 29 and by engaging the opening passing through the connection piece 16 onto the attachment lug. This operation, which can be carried out very rapidly, is followed by bringing the anti-vibration bars 15 to bear on the row of tubes 20** with a defined force.

If the fitting of the anti-vibration bars and of the row 20 is satisfactory, the insertion of the tubes of a new row into the structure of the bundle, and the fitting of a new set of anti-vibration bars, are carried out.

The fitting of the tubes and of the anti-vibration bars, and the mounting of the bundle can thus be carried out very rapidly.

The fastening of the anti-vibration bars is completed by fitting the connection U-rods 19 and welding the outer ends of the anti-vibration bars onto the connection U-rods, or by mechanical fastening.

The invention therefore makes it possible to mount the tube bundle of the steam generator very rapidly. Furthermore, the anti-vibration bars are all joined by a connection piece to the structure of the bundle and are held in a defined radial position.

It is thus possible to use a set of anti-vibration bars including an even number or an odd number of bars arranged in radial directions.

Furthermore, the structure of the elongate element for fastening successive sets of anti-vibration bars is relatively simple, since a single notch and a single attachment lug is necessary at each of the spaces between two adjacent rows of tubes.

The device for fastening the anti-vibration bars can easily be adapted to any number of rows of tubes, this number being in particular a function of the exchange surface area of the steam generator and of the geometrical shape of the network of the holes of the tube plate, of the tube support plates (triangular pitch or rectangular pitch).

The structure of the steam generator according to the invention is perfectly suited to mounting of the tubes by row, making it possible in particular to bring the bends of the tubes to bear correctly on the anti-vibration bars.

The fastening element solidly attached to the upper tube support plate of the steam generator may have a form other than that which has been described and include attachment means made in a different manner.

The pieces for connecting the anti-vibration bars which are intended to be fastened onto the elongate element solidly attached to the upper tube support plate may have a form different from that which has been described and have attachment elements other than the through openings which have been described above.

However, these connection pieces must allow fastening of the anti-vibration bars in radial positions and consequently have a shape which has been described as a dovetail shape. It is, however, clear that the dovetail piece may have a form other than the of a plate or other monobloc piece including radial recession. The dovetail piece may be made by juxtaposition and fastening in adjacent positions of elements which each make it possible to accommodate the end part of one anti-vibration bar.

The outer ends of the anti-vibration bars may be joined by mechanical connection means instead of being fastened by welding onto the connection U-rods.

The invention applies to various heat exchangers of steam generators of a pressurized water nuclear reactor.

We claim:

1. Heat exchanger comprising a bundle of tubes which are bent into a U so as to have two straight branches and a curved part connecting said two straight branches, tube support plates spaced at intervals along the length of said straight branches of said tubes and traversed by said straight branches, said tube support plates retaining said tubes in a regular arrangement in which said straight branches are all parallel to each other and said tubes are positioned in parallel plane rows, a plurality of anti-vibration bars interposed between the rows in the curved part of each pair of adjacent rows of said tubes, and means for fastening and connecting said anti-vibration bars, including at least one elongate element fastened onto said tube support plate adjacent said curved parts of said tubes, in a direction perpendicular to said rows of tubes, within a free space between said tubes located at a central part of said bundle, wherein:

(a) said anti-vibration bars are simple rectilinear bars; and (b) said means for fastening said anti-vibration bars include, between two rows of each said pair of adjacent rows, a connection piece including means for connecting said anti-vibration bars of the plurality of bars, in radial arrangements and in a dovetail disposition, and means for attaching said connection piece to said elongate element.

2. Heat exchanger according to claim 1, wherein said elongate element is a profiled rail including a part for fastening onto said tube support plate and an attachment part defining successive lugs for attachment of the connection pieces for connecting said anti-vibration bars.

3. Heat exchanger according to claim 2, wherein said attachment part of said profiled rail has a shape of a comb with successive teeth comprising lugs for attaching said connection pieces.

4. Heat exchanger according to claim 3, wherein said attachment part of said profiled rail includes successive attachment lugs along the length of said profiled rail made by machining successive notches in a part of said profiled rail.

5. Heat exchanger according to any one of claims 11 to 4, wherein the means for fastening the connection pieces comprise through openings of the connection pieces, intended to be engaged by attachment lugs of said elongate fastening element.

6. Heat exchanger according to any one of claims 11 to 4, wherein the means for fastening and connecting the control bars further include elements for fastening the external ends of said control bars located opposite the ends fixed onto said connection piece.

7. Heat exchanger according to any one of claims 11 to 4, wherein said elongate element is fixed onto said tube support plate by screw and nut assemblies comprising a screw which is engaged in aligned openings passing through said tube support plate and a part of the profiled rail.

8. Heat exchanger according to any one of claims 11 to 4, wherein said connection piece is a solid flat piece with a substantially semi-circular edge in which are provided radial recesses emerging on said semi-circular edge of said connection piece, for engaging and fastening said anti-vibration bars.

9. Heat exchanger according to claim 8, wherein said recesses for engaging said control bars are smooth openings for receiving the ends of said anti-vibration bars at which said connection piece is traversed by holes aligning with corresponding holes in the end part of said anti-vibration bars for engaging fastenings pins.

10. Heat exchanger according to claim 8, wherein the openings for receiving said control bars in said connection piece are tapped openings, and said antivibration bars have threaded ends for screwing in said tapped openings.

* * * * *